US010655246B2

(12) United States Patent
Wang

(10) Patent No.: US 10,655,246 B2
(45) **Date of Patent: *May 19, 2020**

(54) METHOD FOR PRODUCING SINGLE-HOLE ULTRA SOFT YARNS

(71) Applicant: LOFTEX USA LLC, New York, NY (US)

(72) Inventor: Hongxing Wang, Shandong (CN)

(73) Assignee: LOFTEX USA LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/270,346

(22) Filed: Sep. 20, 2016

(65) Prior Publication Data

US 2017/0370028 A1 Dec. 28, 2017

Related U.S. Application Data

(60) Provisional application No. 62/355,581, filed on Jun. 28, 2016.

(51) Int. Cl.

| | |
|---|---|
| ***D03D 1/00*** | (2006.01) |
| ***D02G 3/40*** | (2006.01) |
| ***D03D 15/00*** | (2006.01) |
| *D01G 13/00* | (2006.01) |

(52) U.S. Cl.

CPC ..... *D03D 1/0017* (2013.01); *D02G 3/406* (2013.01); *D03D 15/00* (2013.01); *D01G 13/00* (2013.01); *D10B 2201/02* (2013.01); *D10B 2321/06* (2013.01); *D10B 2331/04* (2013.01); *D10B 2401/024* (2013.01)

(58) Field of Classification Search

CPC .. D01D 5/24; D01H 7/76; D01H 7/86; D02G 3/28; D02G 3/36; D02G 3/362

See application file for complete search history.

(56) References Cited

U.S. PATENT DOCUMENTS

| | | | | | |
|---|---|---|---|---|---|
| 2,503,987 | A * | 4/1950 | Anderson | D07B 7/02 | 57/138 |
| 2,540,833 | A * | 2/1951 | Pitt | D07B 7/02 | 57/138 |
| 2,724,944 | A * | 11/1955 | Carleton | D07B 3/04 | 57/138 |
| 3,872,659 | A * | 3/1975 | Campbell | D07B 1/0693 | 57/33 |
| 3,952,372 | A * | 4/1976 | Howell, Jr. | D01H 5/18 | 19/238 |
| 3,994,046 | A * | 11/1976 | Brown | D01H 5/72 | 19/150 |
| 4,124,972 | A * | 11/1978 | Arai | D01H 1/115 | 57/328 |
| 4,888,856 | A * | 12/1989 | Yescheskel | D01G 99/00 | 19/0.27 |
| 5,259,180 | A * | 11/1993 | Nortenius | G02B 6/4479 | 57/264 |
| 5,689,945 | A * | 11/1997 | Tobler | D01H 5/74 | 19/150 |
| 7,310,856 | B2 * | 12/2007 | Temburg | D01H 5/005 | 19/257 |
| 7,500,345 | B2 * | 3/2009 | Kish | B21F 7/00 | 57/138 |
| 8,733,075 | B2 * | 5/2014 | Mandawewala | D02G 3/36 | 139/1 R |
| 2002/0073682 | A1 * | 6/2002 | Greenwood | G02B 6/449 | 57/3 |
| 2008/0104827 | A1 * | 5/2008 | Kish | H01F 5/02 | 29/605 |
| 2012/0076971 | A1 * | 3/2012 | Debnath | D02G 3/04 | 428/85 |
| 2015/0211154 | A1 * | 7/2015 | Hightower, III | D02G 3/36 | 428/221 |
| 2017/0370022 | A1 * | 12/2017 | Wang | D01D 5/24 | |
| 2017/0370029 | A1 * | 12/2017 | Wang | D03D 1/0017 | |

* cited by examiner

*Primary Examiner* — Shaun R Hurley
(74) *Attorney, Agent, or Firm* — Leason Ellis LLP

(57) ABSTRACT

The present invention provides a method for successively introducing water soluble fibers into natural fibers (e.g. cotton) to produce a hollow and ultra soft structure, by introducing water soluble slivers into the center of a multi-hole feeder with multiple cotton fiber slivers arranged around the water soluble fiber in a pre-drawing process via a multi-hole sliver feeder. A cloth, e.g., made using the method.

12 Claims, 4 Drawing Sheets

METHOD FOR PRODUCING SINGLE-HOLE ULTRA SOFT YARNS

CROSS REFERENCE TO RELATED APPLICATION

This application claims benefit to U.S. Provisional Application No. 62/355,581, filed Jun. 28, 2016, entitled "Method for Producing Single-Hole Ultra Soft Yarns and Method for Producing Multi-Hole Ultra Soft Yarns," which is hereby incorporated by reference in its entirety.

TECHNICAL FIELD

The present invention relates to a method for producing single-hole ultra soft yarns, belonging to the technical field of fiber spinning, and making cloth therefrom.

BACKGROUND OF THE INVENTION

During the exploitation of such yarns, the following three methods are known to introduce PVA (polyvinyl alcohol) fibers into the center of cotton yarns via a ring spinning system.

The first method is a spinning process in which PVA fibers are put into the core of cotton yarns on a spring frame, and PVA spun yarns are embedded into the streams of cotton fibers in a drafting zone during spinning Since the cotton fibers in the outer sheath are likely to cluster into bundles during the weaving process, PVA fibers are unevenly spread on the surface of the yarns, resulting in uneven thickness of the yarns and thus insufficient hollowness and softness of towels made of such yarns.

The second method is a spinning process in which PVA fiber slivers (formed by carding) are put into the center of cotton slivers (formed by carding) in a drawing process of a spinning system for purpose of blending. It is unable to ensure that PVA fibers will be evenly wrapped by cotton fibers to form a hollow structure, even if the fibers are evenly blended in this process.

The third method is a process in which PVA slivers are embedded into the center of cotton slivers at a feeding end of the drafting zone of a roving frame, twisted on the roving frame, and then spun. After tests and a number of improvements, this method is regarded as the most hopeful method for achieving hollow PVA. However, only a single-hole hollow structure may be formed due to the restriction of the process.

The present invention provides a method for successively putting water soluble fibers into natural fibers (e.g. cotton) to produce a hollow and ultra soft structure, by putting water soluble slivers into the center of a multi-hole feeder with multiple cotton fiber slivers arranged around the water soluble fiber in a pre-drawing process via a multi-hole sliver feeder.

SUMMARY

According to one aspect of the invention, a method of producing soft yarns comprises the steps of providing a plurality of finish fibers and providing a water soluble fiber. A multi-hole drawing tool is provided. The plurality of finish fibers and the water soluble fiber are introduced into respective holes of the multi-hole drawing tool with the finish fibers arranged around the water soluble fiber. The finish fibers and the water soluble fibers are drawn through the multi-hole drawing tool to form a combined fiber, the combined fiber having the water soluble fiber surrounded by the finish fiber. The combined fiber is then roved.

According to a further aspect, the combined fiber is exposed to water to remove the water soluble fiber.

According to another aspect, the finish fiber is cotton.

According to a further aspect, the water soluble fiber is PVA.

According to another aspect, the multi-hole drawing tool includes six holes arranged about a central seventh hole.

According to a yet further aspect, the introducing step includes the steps of passing the water soluble fiber into the central seventh hole and the finish fibers into the other six holes.

According to a further aspect, method of manufacturing a cloth is provided that includes the step of weaving the cloth using at least one yarn produced by the methods disclosed above.

According to a further aspect, a cloth is provided that includes at least one yarn produced by the methods disclosed above.

According to a further aspect, a towel is provided that includes at least one yarn produced by the methods disclosed above.

DETAILED DESCRIPTION OF CERTAIN EMBODIMENTS

Figure 1:
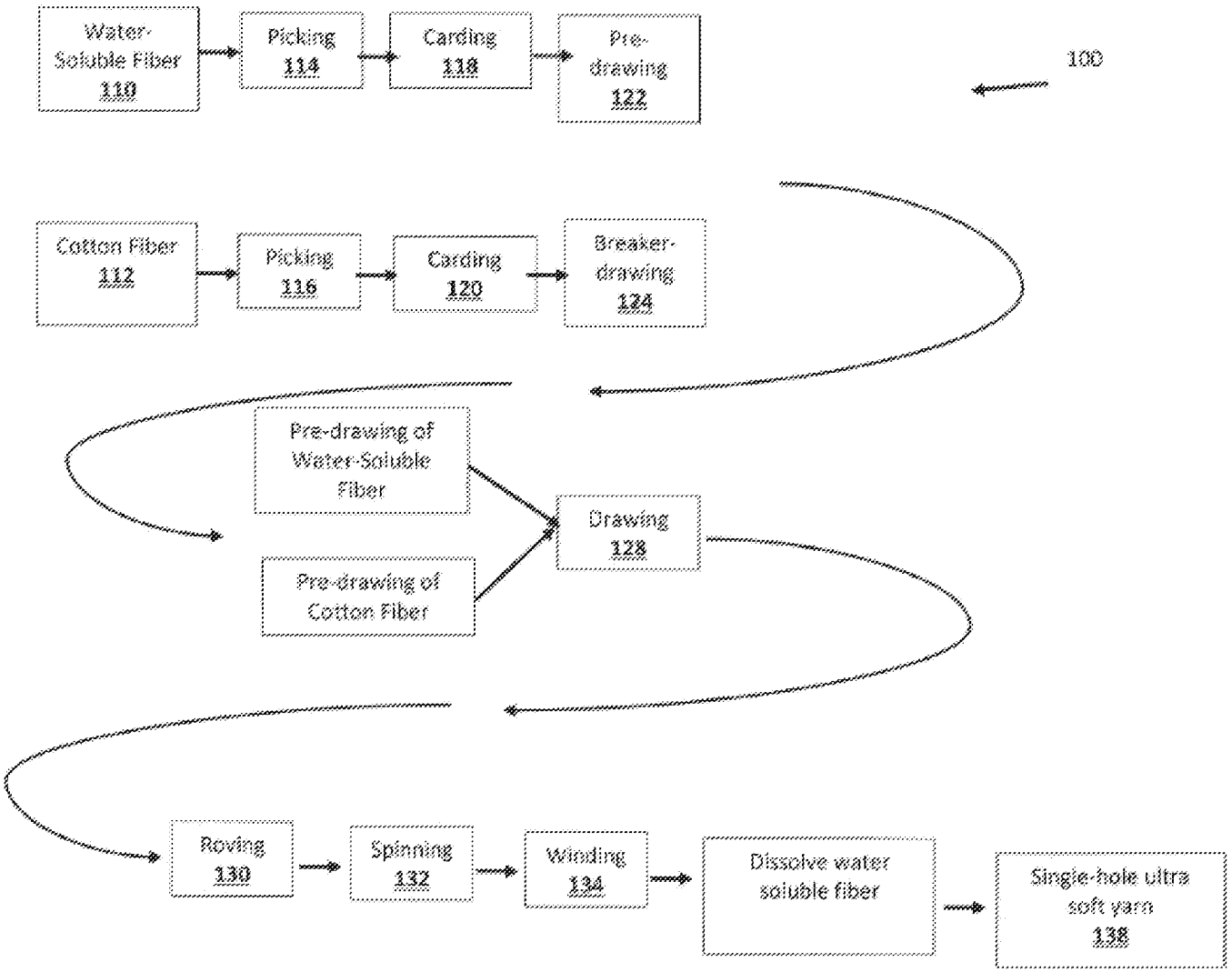
FIG. 1 is a flow chart illustrating a wrapping process of single-hole ultra soft yarns.

The present invention comprises a method 100 for forming an ultra-soft yarn according to the steps shown in FIG. 1. The process involves the steps of combining a finish fiber and a water soluble fiber and then dissolving the water soluble fiber. The finish fiber is the fiber that remain after the water soluble fiber is dissolved. The process is described herein according to example in which the finish fiber is cotton and the water soluble fiber is PVA. In other example, the finish fiber can be other natural fibers or synthetic fibers and the water soluble can be suitable alternatives to PVA.

At steps 110 and 112, the materials that are to be blended to form the yarn are selected. At step 112, cotton fibers are selected. As one example, the physical indexes of the cotton fibers can be 29 mm or more in length, Micronaire A, short fiber content 10% or less. At step 110, a water soluble fiber is selected. As one example, the water soluble fiber can be PVA fibers having the following characteristics: body length: 38 mm; fineness: 1.33 dtex; dissolution temperature: 90° C. or less. It is desirable to select cotton fibers within the index disclosed or relatively close thereto because if the cotton fibers are far out of the indexes, there is a possibility that cohesion between the cotton fibers during the dissolution of PVA cannot be ensured. As a result, monofilaments can fall off from the yarns and molt rate of towels thus becomes high.

The production process 100 includes two main steps: (1) PVA pre-drawing slivers and cotton card slivers are spun, respectively; and the cotton fiber card slivers and the pre-drawing PVA slivers are fed into an additional 7-hole sliver feeder (see FIG. 3) during a breaker-drawing process, with the PVA fiber slivers into the hole in centre and the cotton fiber slivers into the surrounding six holes, and (2) subsequently subjected to stretching, twisting and winding to produce the yarns. The production process 100 and the details surrounding these two main steps are discussed in more detail below.

One example of the process flow is shown in the table below:

| | |
|---|---|
| Water-soluble fibers: FA002 Disk Plucker → A006B Automatic Blending Machine → A092A Double Hopper Feeder → A076E Lapper → A186D Carding Machine → FA304 Pre-drawing Machine | |
| Cotton Fibers: FA002 Disk Plucker → A006B Automatic Blending Machine → FA104 Step Cleaner → A092A Double Hopper Feeder → A076E Lapper → FA201 Carding Machine → FA304 Pre-drawing Machine | |
| Pre-drawing of water-soluble fibers<br>Pre-drawing of cotton fibers | FA304 Drawing Frame (sing-hole) → Roving Frame → FA507 Spinning Frame → Savio Automatic Winding Machine → Dissolve water soluble fiber |

Figure 2:
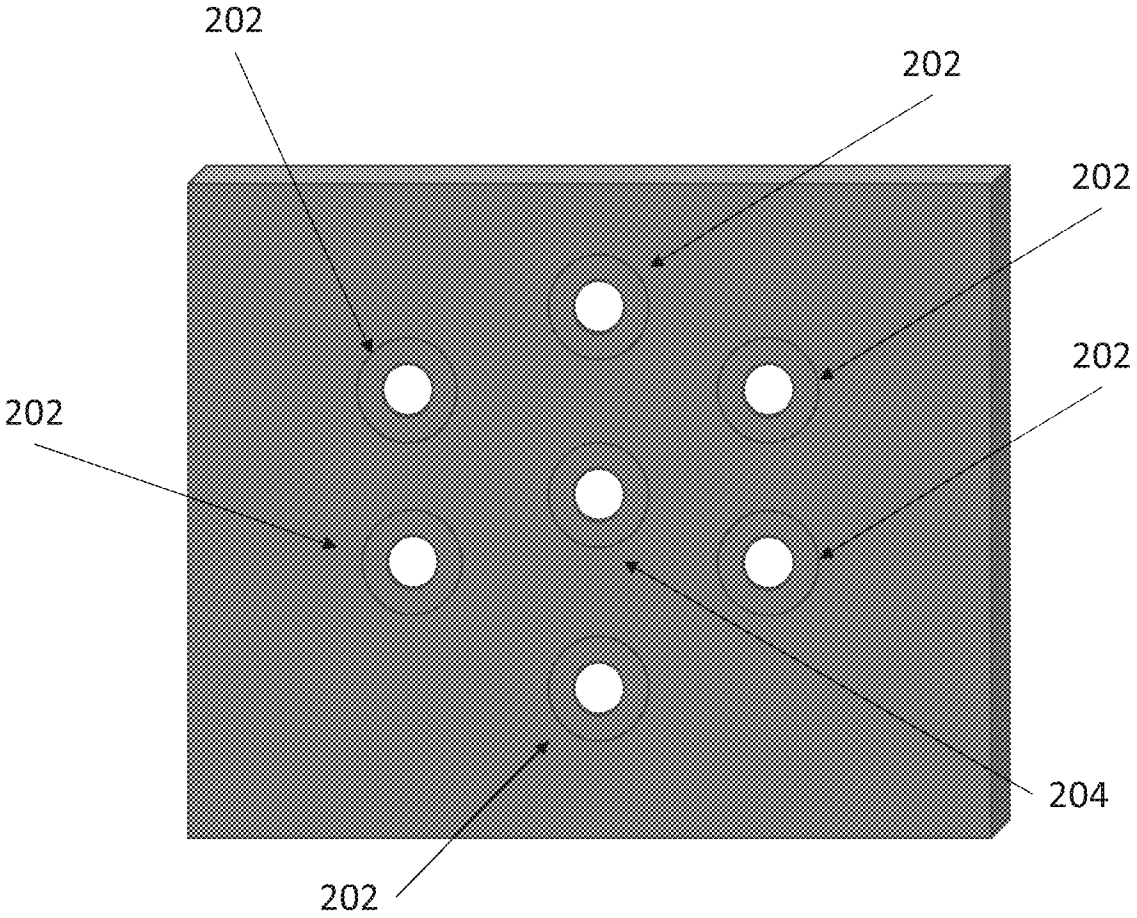
FIG. 2 is a schematic view of arrangement of cotton fibers and a water-soluble fiber fed during a breaker-drawing process.

The arrangement of the first passage drawn sliver and PVA is: cotton, cotton, cotton, PVA, cotton, cotton, cotton (see, for example, FIG. 2). (This arrangement is required since the apparatus is so designed. The content of cotton can be increased or decreased as long as it is within the range from 70% to 95%, but it is important to ensure that PVA is in the center of cotton slivers).

At steps 114 and 116, the water soluble fibers and cotton fibers, respectively, undergo picking operations. Due to different characteristics of the cotton fibers and the PVA water-soluble fibers, the cotton fibers are blended in two hoppers, with two positions for opening and cleaning, and the PVA fibers are blended in two hoppers, with one position for opening and cleaning. The combined beater is a three-blade combined beater. If the PVA fibers are beaten too much, the fibers may be damaged and kinked. Therefore, as one example, the speed of the combined beater is approximately 1000 rpm/min for the cotton fibers and approximately 820 rpm/min for the PVA fibers, and the gauge between grid bars is minimized to reduce the amount of noils. As one example, the weight of a cotton lap is approximately 400 g/m, and the weight of a PVA fiber lap is approximately 380 g/m.

At steps 118 and 120, the water soluble fibers and cotton fibers, respectively, undergo picking operations. During picking, the PVA fibers can be treated by metal card clothing. To avoid congesting the card clothing, the speed of taker-in is approximately 920 rpm/min during cotton spinning and is approximately 790 rpm/min during PVA fiber spinning. The speed ratio of cylinder to taker-in is approximately 1.7:1 during cotton spinning and is approximately 2.2:1 during PVA fiber spinning. The purpose is to facilitate the transfer of fibers and to reduce damage to the fibers in order to avoid the generation of short fibers. Some gauges are adjusted according to different fibers as shown in the following table:

| | Cotton | PVA fiber |
|---|---|---|
| Feed plate-Taker-in | 7 | 12 |
| Taker-in-dust remover | 12 | 15 |
| Cylinder - Cover | 8/7/7/7/8 | 12/11/10/10/11 (five continuous gauges) |

The unit of those mentioned above is mil.

At steps 122 and 124, the water soluble fibers and cotton fibers, respectively, undergo drawing operations. After these drawing operations, the cotton fibers and water soluble fibers undergo an additional drawing operation at step 128 to blend the fibers, as discussed in more detail below.

A blend ratio for the cotton slivers and the water soluble slivers is selected. As one example, the water soluble fiber (e.g. PVA) is approximately 5% to 30%, and the cotton is approximately 70%-95%. After many tests, an acceptable yarn blending ratio is defined in this range. If the content of PVA is much greater than 30%, the strength of the yarns is too low, resulting in a high molt rate when in use and affecting the wrapped effect of the PVA fibers by the cotton fibers. If the content of PVA is much less than 5%, the single-hole effect provided by the dissolving of the water soluble fiber is insufficient and it is unable to achieve ultra-soft, highly bulky and high absorption effects.

At step 128, the cotton fibers and water soluble fibers undergo a drawing process to blend the fibers such that the cotton fibers are arranged around and surrounding the water soluble fiber. As shown in FIG. 2, the cotton fiber 202 and the PVA fibers 204 are fed into an additional 7-hole sliver feeder 200 during a breaker-drawing process, with the water-soluble fiber slivers into the hole in the center and the cotton fiber slivers into the surrounding six holes. The fibers can be subsequently subjected to second and third drawing to wrap the water-soluble fibers. A 7-hole feeder 200 is shown, however, feeders with other numbers of holes can be used so long as cotton fibers are arranged to surround a water soluble fiber.

In one example, the three-up-three-down press bar drafting process is utilized. When breaker slivers are fed, the cotton and the PVA fibers are fed into an additional 7-hole sliver feeder 200 during a breaker-drawing process, with all the cotton fibers 202 in the outer layer and the water-soluble fibers 204 in the inner layer. For both the cotton fibers and the water-soluble fibers, the roller gauge can be approximately 12 mm×20 mm, and the spacer of the press bars is approximately 2.0 mm, for the purpose of enhancing the control on fibers.

At step 130, the combined cotton and water soluble fibers undergo a roving process. During the roving process, a three-roller double-apron drafting can be utilized. The roving amount can be approximately 5-8 g per 10 m, and the roller gauge can be approximately 26.5 mm×33.5 mm. The dissociated fibers are controlled in the drafting zone. Roving twist factor is defined as 70-90 based on the different proportions of the PVA fibers, the spinning back region process, and other conditions.

At step 132, the combined cotton and water soluble fibers undergo a spinning operation. According to the roving amount and the density of fine yarns, different drawing ratios and twist factors are designed. In one example, the density of fine yarns is 40 S-6 S. According to the density of fine yarns and the blending ratio, the twist factor is selected from approximately 260 to 400. After drawing the density of fine yarn is approximately 1.20-1.42, and the roller surface gauge is adjusted to approximately 21 mm×28 mm.

At step 134, the combined cotton and water soluble fibers undergo a winding process. The process principle of winding is "small tension, low speed". In order to reduce hairiness and decrease the breaking rate, low speed and small tension are set. A capacitive electronic yarn clearer is used to improve the joint efficiency of the air splicer and reduce the yarn defects. In order to ensure the yarn strength and the moisture regain, the workshop temperature is controlled at approximately 28° C.-32° C., the relative humidity is controlled at approximately 65%-75%, and the winding speed is designed at approximately 900 m/min, all of which enable a better compromise between productivity and quality of cheeses.

Figure 3:
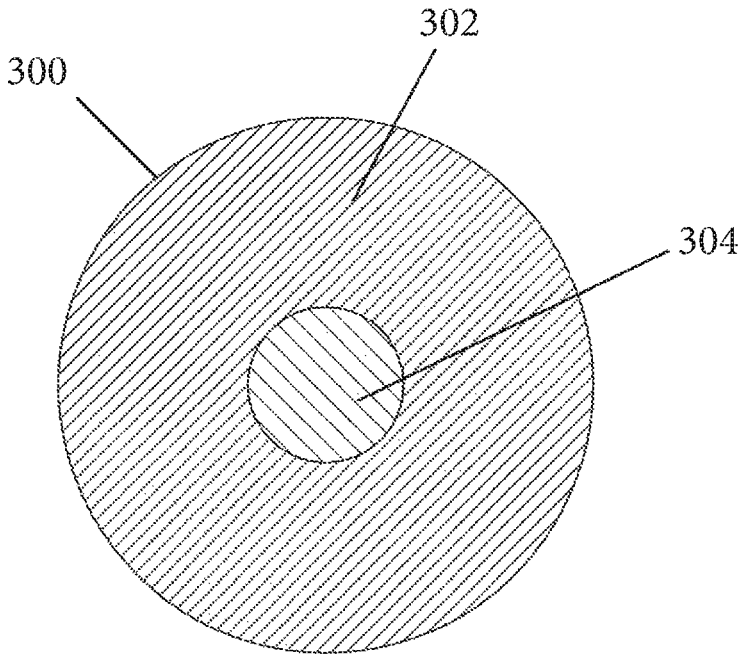
FIG. 3 is a structure diagram of the single-hole super soft yarns.

Accordingly, a fiber 300 consisting of cotton fibers surrounding 302 a water soluble fiber 304 is provided as shown in FIG. 3. At step 138, the fiber 300 is exposed to warm water to dissolve the water soluble fiber 304. This process results in a cotton fiber with a hollow core, which is soft and absorbent. The water dissolving step can be performed after the combined fiber has been manufactured into an article (e.g., towel, garment, etc.).

Six cotton fibers and one water-soluble fiber are fed into a breaker-drawing frame, with the cotton fibers being evenly spread around the water-soluble fiber to completely wrap the water-soluble fiber. In such a feeding mode, the cotton fibers are in the outer layer and the water-soluble fiber in the inner layer. Subsequently, by drawing and drafting, the water-soluble fiber is further dispersed in the cotton fibers.

Figure 4:
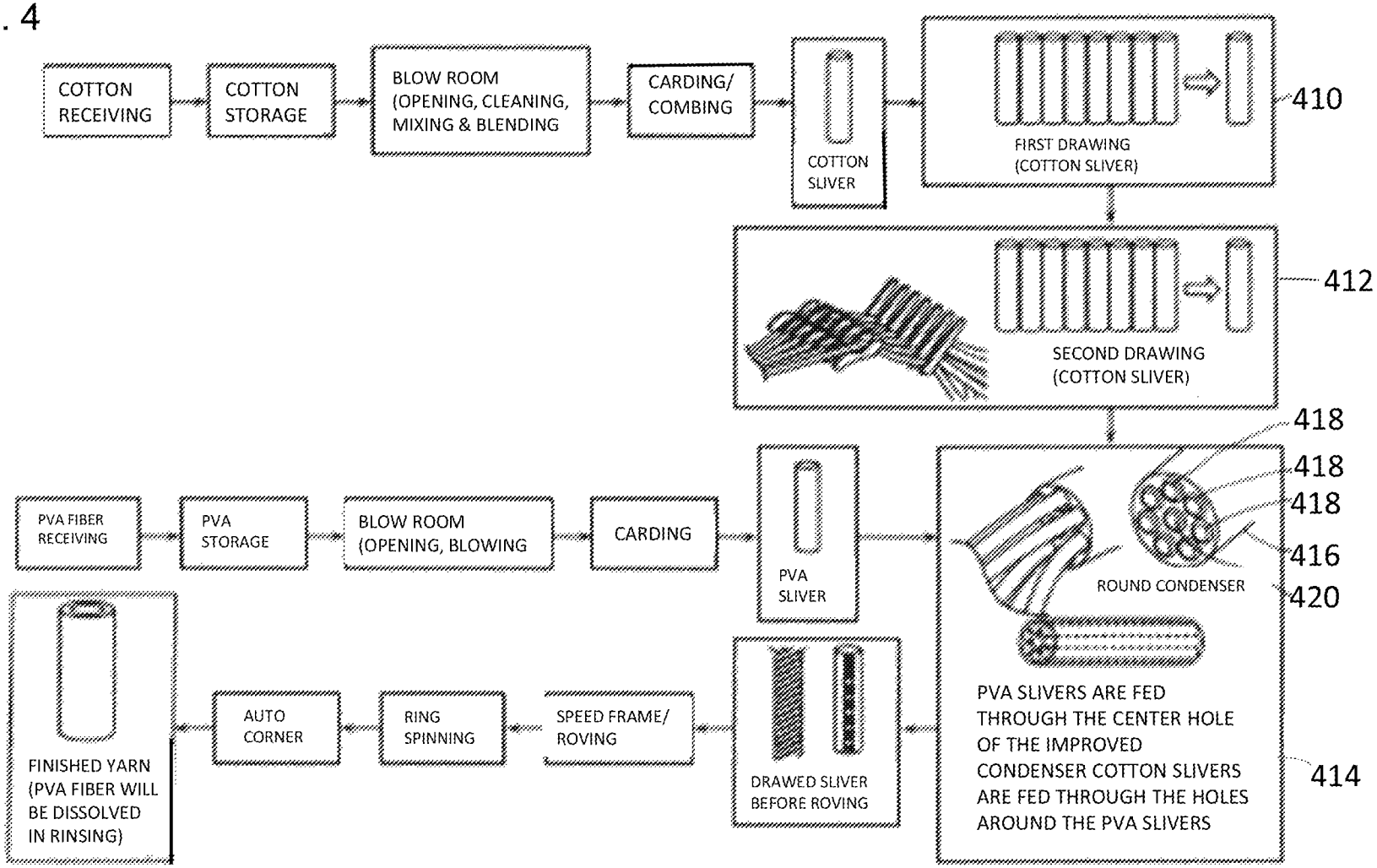
FIG. 4 is a flow chart illustrating a wrapping process of single-hole ultra soft yarns having additional drawing steps.

FIG. 4 is a flow chart illustrating a manufacturing process 400 for producing ultra soft yarns similar to the process illustrated in FIG. 1. Accordingly, to process 400, the cotton slivers can undergo a first drawing at step 410 and a second drawing at step 412 prior to the drawing process 414 in which the water soluble fiber is introduced. As can be seen, the cotton slivers 418 are arranged around a central water soluble sliver 420 as the slivers are passed through a multi-hole condenser 416.

The following chart illustrates differences and performance improvements between the yarn of the present invention and prior art yarns.

Performance Comparison Between Yarns Obtained by the Present Invention and Yarns Obtained by the Prior Art

| Method and performance comparison | Yarns obtained by the present invention | Yarns obtained by the prior art |
|---|---|---|
| Spinning Method | Putting PVA slivers in the center of the yarn slivers | Blending PVA fibers and cotton in hoppers<br>Ordinarily blending PVA slivers and cotton slivers |
| Structure | PVA fibers can tend to be continuously present in the center of the yarn body, not exposed to the surface; and after completely removing the PVA, voids in the yarn body are larger and more uniform. | Most of PVA fibers exposed to the yarn body; and after removing the water-soluble fiber, micropores are not continuous. |
| Bulkiness | good | normal |
| Quick-drying | good | normal |
| Softness | better | normal |
| Formation process | Pre-drawing<br>With the 7-hole yarn guide means, a uniform hollow structure is formed, with PVA fibers evenly distributed in the yarn, soft and bulky; and even after repeated washing, the molt rate is very small. | Pre-drawing<br>Since there is no yarn guide means, the distribution of PVA fibers in the cotton yarns is uneven and this may lead to yarn unevenness; the thickness of the cotton yarns after dissolved off PVA is uneven; and the molt rate is high. |

The method of the present invention can be used to manufacture cloth that can be manufactured into various article, such as ultra soft towels. Accordingly, card slivers are produced from cotton fibers by picking and carding and pre-drawing silvers are produced from PVA fibers by picking, carding and pre-drawing. The cotton fiber card slivers and the pre-drawing PVA silvers are fed into an additional 7-hole sliver feeder (see FIG. 3) during a breaker-drawing process, with the PVA fiber slivers into the hole in center and the cotton fiber slivers into the surrounding six holes, and subsequently subjected to stretching, twisting and winding to produce the yarns. When towels made of such yarns are placed into hot water, PVA fibers are dissolved to form a single-hole ultra soft cotton ring structure.

Grey cloth is produced from the single-hole ultra soft yarns via a towel loom, and then fed into a combined desizing-scouring machine where PVA fibers are dissolved in hot water at 40° C.-100° C., and the PVA is completely removed by multiple times of washing. The grey cloth, which is removed off PVA fibers by washing, is subjected to scouring and bleaching, dyeing, soap boiling, softening, drying, stitching and finishing to produce a single-hole ultra soft towel.

A finished towel made of such single-hole ultra soft yarns is lightweight, plump and flexible, and can keep the softness for a long period of time. A towel made of such single-hole ultra soft yarns is lighter, and higher in absorbance. Such single-hole ultra soft yarns are preferred raw materials for weaving towels. A high-quality towel made of such single-hole ultra soft yarns is bounded with fine satin, exhibiting high taste.

The invention claimed is:

1. A method of producing soft yarns, comprising the steps of:

receiving from a first pre-drawing machine a plurality of finish fibers;

receiving from a second pre-drawing machine a water soluble fiber;

providing a multi-hole drawing tool, the multi-hole drawing tool having a center passage disposed therethrough configured to allow the passage of the water soluble fiber and at least two finish fibers passages disposed therethrough and configured to allow passage of the one of the at least two finish fibers of the plurality of finish fibers in each respective finish fiber passage;

producing a combined fiber by:

drawing each of the received plurality of finish fibers through a respective one of the at least two finish fibers passages and the received water soluble fiber through the center passage such that the at least two finish passages are arranged around the water soluble fiber passage to form the combined fiber; and providing the combined fiber to a speed frame.

2. The method of claim 1, further including the step of exposing the combined fiber to water to remove the water soluble fiber.

3. The method of claim 1, wherein the finish fiber is cotton.

4. The method of claim 1, wherein the water soluble fiber is PVA.

5. The method of claim 1, wherein the multi-hole drawing tool includes six finish fiber passages arranged about the center passage.

6. The method of claim 1, further including the step of generating a yarn from the combined fiber.

7. A method of manufacturing a cloth, comprising the steps of:

weaving the cloth using at least the yarn produced by the method of claim 6.

8. A cloth including at least the yarn produced by the method of claim 6.

9. A towel including at least the yarn produced by the method of claim 6.

10. The method of claim 1, further comprising the steps of:

spinning the combined fiber;

winding the combined fiber; and dissolving the water soluble fiber.

11. The method of claim 1, wherein the percentage of water soluble slivers relative to the total combined fiber is approximately 5% to 30%.

12. A method of producing soft yarns, consisting essentially of:

drawing on a first drawing machine of a plurality of finish fibers;

drawing on a second drawing machine a water soluble fiber;

providing a multi-hole drawing tool, the multi-hole drawing tool having a center passage disposed therethrough configured to allow the passage of the water soluble fiber and at least two finish fibers passages disposed therethrough and configured to allow passage of the one of the at least two finish fibers in each respective finish fiber passage;

producing a combined fiber, prior to a speed frame process, by drawing the finish fibers and the water soluble fiber through the multi-hole drawing tool to form the combined fiber, the combined fiber having the water soluble fiber surrounded by the finish fiber; and providing the combined fiber to a speed frame.

* * * * *